US006609366B2

(12) United States Patent
Kameyama

(10) Patent No.: US 6,609,366 B2
(45) Date of Patent: Aug. 26, 2003

(54) BRANCH PIPES FOR AN EXHAUST MANIFOLD AND METHOD OF MANUFACTURING THE SAME

(75) Inventor: Tatsuya Kameyama, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/084,450

(22) Filed: Feb. 28, 2002

(65) Prior Publication Data

US 2002/0139116 A1 Oct. 3, 2002

(30) Foreign Application Priority Data

Mar. 30, 2001 (JP) ..... 2001-099303

(51) Int. Cl.[7] ..... F01N 7/10

(52) U.S. Cl. ..... 60/323; 60/274; 60/313; 29/890.08

(58) Field of Search ..... 60/274, 313, 323; 29/890.08; 285/150

(56) References Cited

U.S. PATENT DOCUMENTS 4,815,274 A * 3/1989 Piatti ..... 60/313
5,572,868 A * 11/1996 Okamoto et al. ..... 60/323
5,727,386 A * 3/1998 Watanabe et al. ..... 60/323
5,787,709 A * 8/1998 Watanabe et al. ..... 60/313
6,122,911 A * 9/2000 Maeda et al. ..... 60/323
6,199,376 B1 * 3/2001 Maeda ..... 60/323

FOREIGN PATENT DOCUMENTS

JP 9-236012 9/1997

* cited by examiner

*Primary Examiner*—Thomas Denion
*Assistant Examiner*—Tu M. Nguyen
(74) *Attorney, Agent, or Firm*—Foley & Lardner

(57) ABSTRACT

Downstream fitting parts of exhaust manifold branch pipes which fit into a manifold container each has a sector or fan-like cross section which is formed so that the cross-section area of the downstream end of each of the branch pipes is substantially equal to that of the corresponding upstream end. During manufacture, the downstream ends of each pipe member are expanded by a predetermined amount and then shaped to have the fan or sector-like shaped cross section. This maintains the cross-sectional area of the shaped portions substantially equal to the original cross-sectional areas and therefore the cross-sectional area of the upstream ends.

3 Claims, 4 Drawing Sheets

BRANCH PIPES FOR AN EXHAUST MANIFOLD AND METHOD OF MANUFACTURING THE SAME

BACKGROUND OF THE INVENTION

The present invention relates to branch pipes mounted to an exhaust manifold of an internal combustion engine, and a method of manufacturing the same.

This type of the exhaust manifold is known as disclosed in the Unexamined Japanese Patent Application Publication No. Hei9-236012.

An example of the exhaust manifold is shown in FIGS. 6 and 7.

An exhaust manifold 1 is made up of a flange 2 fastened to the exhaust side of an engine, four branch pipes 3 coupled to the flange 2, and a manifold container 4 with a branch-pipe mounting part 4*a* into which those branch pipes 3 are fit in a state that those are arranged in parallel. The fitting part 3*a* of each branch pipe 3 at which the branch pipe is fit into the branch-pipe mounting part 4*a* is shaped like a fan in cross section.

An $O_2$ sensor 5 is attached to the manifold container 4 at a position near the base parts of those branch pipes 3.

A manifold converter 6 as a cylindrical container, elliptical in cross section, is coupled to a downstream side of the manifold container 4.

A metal catalyst carrier 7 for purifying exhaust gas is contained in the manifold converter 6.

In the exhaust manifold 1, exhaust gas discharged from the engine is introduced from a plurality of branch pipes 3 into the manifold container 4, and an oxygen concentration in the exhaust gas is measured by the $O_2$ sensor 5 and introduced into the manifold converter 6.

Thereafter, the exhaust gas is purified by the metal catalyst carrier 7, and discharged out through an exhaust gas discharging port 8. Then, it is guided into a muffler (not shown) for deadening the sound of exhausting gases, and then is discharged into the air.

The branch pipes 3 are shaped to have their fitting parts 3*a* whose cross section is fan in shape.

In the shaping process, the peripheral length adjustment is used. Accordingly, a cross section area of the resultant fitting part is smaller than that of an original pipe 9, as shown in FIG. 8.

Specifically, a cross section area S1 of the fitting part 3*a* is equal to the result of subtracting cross section areas S2 and S3 of two crescent-like parts from the cross section area S of the original pipe 9.

The reduction of the cross section area will adversely affect the pressure loss. In other words, this possibly leads to the engine output reduction.

SUMMARY OF THE INVENTION

Accordingly, an object of the present invention is to provide branch pipes for an exhaust manifold which are able to reduce the pressure loss and a method of manufacturing the same.

The above object is achieved by branch pipes for an exhaust manifold in which a fitting part to be fit into a manifold container comprises a group of pipe members, wherein a cross section of the fitting part of each branch pipe is shaped into a fan-like shape, and the cross sectional area of the branch pipe is substantially equal to that of the branch pipe before the branch pipe is worked.

To achieve the above object, there is also provided a method of manufacturing the exhaust manifold branch pipes as mentioned in aspect 1. The manufacturing method comprises a step of expanding the end of each pipe member, and a step of shaping the expanded end of the pipe member into a fan-like shape in cross section.

BRIEF DESCRIPTION OF THE DRAWINGS

FIG. 1 is a front view showing an exhaust manifold using exhaust manifold branch pipes, which form an embodiment of the present invention.

FIG. 2 is a bottom view showing a key portion of the exhaust manifold of FIG. 1.

FIG. 3 is a cross sectional view showing a key portion of the FIG. 1 exhaust manifold.

FIG. 4 is an explanatory diagram for explaining a manufacturing process of the FIG. 1 branch pipe.

FIG. 5 is another explanatory diagram for explaining a manufacturing process of the FIG. 1 branch pipe.

FIG. 6 is a front view showing a conventional exhaust manifold.

FIG. 7 is a cross sectional view showing the FIG. 6 exhaust manifold.

FIG. 8 is an explanatory diagram for explaining a manufacturing process of the FIG. 6 branch pipe.

DETAILED DESCRIPTION OF THE PREFERRED EMBODIMENTS

The preferred embodiment of the present invention will be described with reference to the accompanying drawings.

FIGS. 1 to 5 show an exhaust manifold using branch pipes for an exhaust manifold (referred to as branch pipes), which form an embodiment of the present invention (corresponding to aspect 1).

Figure 1:
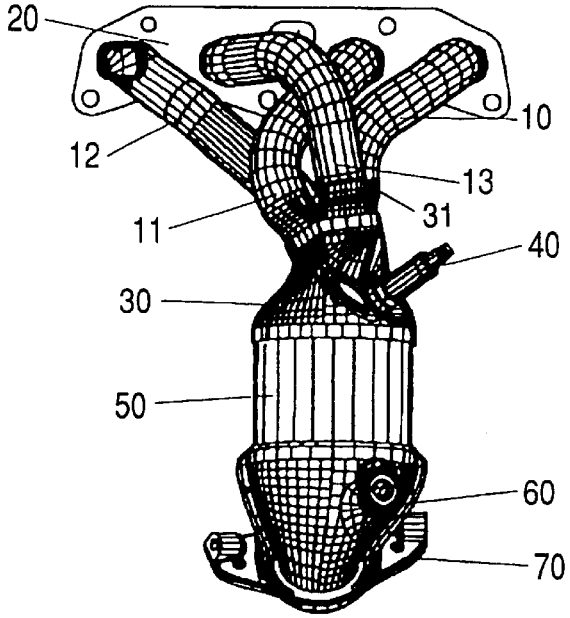
[FIG. 1]
Figure 2:
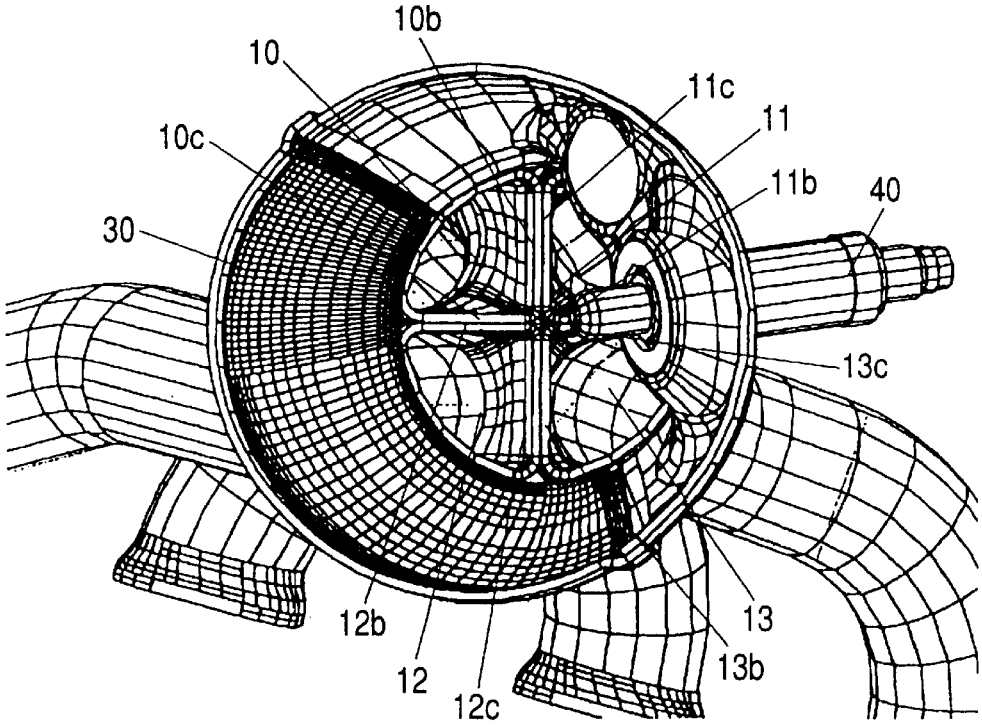
[FIG. 2]
Figure 3:
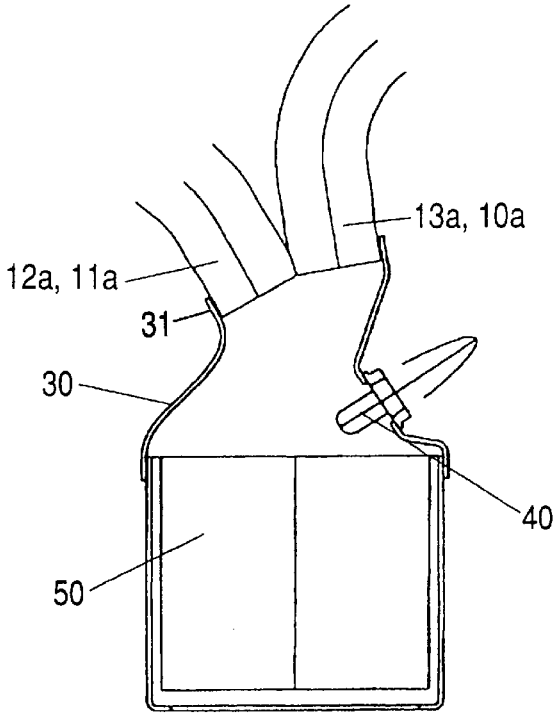
[FIG. 3]

In an exhaust manifold of the embodiment, as shown in FIGS. 1 to 3, four branch pipes 10, 11, 12, 13, which are each circular in cross section, are fastened at the upstream side to a flange 20 fastened to the exhaust side of an engine, and are coupled at the downstream side of those pipes to a manifold container 30.

An $O_2$ sensor 40 is attached to the manifold container 30. A catalytic converter 50 is mounted on the manifold container 30. The catalytic converter 50 is consecutively coupled to a lower side container 60 and a flange 70 on which the container 60 is mounted.

In the embodiment, the branch pipe 10 is communicatively coupled to a first cylinder of the engine; the branch pipe 11, to a second cylinder; the branch pipe 12, to a third cylinder; and the branch pipe 13, to a fourth cylinder.

Parts (fitting parts) 10*a*, 11*a*, 12*a*, 13*a* of the ends of the branch pipes 10, 11, 12, 13, which are fit into a branch pipe mounting part 31, are each shaped like a fan in cross section.

A cross section area SX of the parts (fitting parts) 10*a*, 11*a*, 12*a*, 13*a*, which are fit into a branch pipe mounting part 31, is substantially equal to across section area S of non-worked parts (original pipes) of the branch pipes 10, 11, 12, 13, which are each circular in shape.

The branch pipe mounting part 31, as shown in FIGS. 1 and 2, is curved toward the outside of the manifold container 30.

The parts (fitting parts) 10*a*, 11*a*, 12*a*, 13*a* to be fit into the branch pipe mounting part 31, as shown in FIGS. 2 and 3, are put in such a state that the walls 10*c*, 12*b*, 12*c*, 13*b*, 13*c*, 11*a*, 11*b*, 10*b* are brought into surface contact with one another. In this state, those fitting parts are arranged about the center line of the branch pipe mounting part 31 of the manifold container 30, while being slanted with respect to the center line at a given angle. At the branch pipe mounting part 31, those branch pipes 10 to 13 are consecutively arranged in the order of the branch pipes 10, 13, 11, 12.

The other portions of the branch pipes 10, 11, 12, 13 than the parts (fitting parts) 10*a*, 11*a*, 12*a*, 13*a* to be fit into the branch pipe mounting part 31 are each circular in cross section, like the normal branch pipes, and the coupling parts of those portions to the bracket 20 are each rectangular in cross section.

The walls 10*c*, 12*b*, 12*c*, 13*b*, 13*c*, 11*a*, 11*b*, 10*b* are welded together by welding applied onto the inside of the manifold container 30, and reliably fastened together.

As described above, in the embodiment, the parts (fitting parts) 10*a*, 11*a*, 12*a*, 13*a* to be fit into the branch pipe mounting part 31 are formed in a manner that a pipe having a circular cross section is worked into a pipe having a fan-shaped cross section, and the cross section area SX of it is substantially equal to the cross section area S of the non-worked part (original pipe) of each of the branch pipes 10, 11, 12, 13, which are each circular in shape. Accordingly, the branch pipes of the invention succeeds in reducing the pressure loss to be smaller than that of the conventional branch pipes. In other words, there is no case of reducing the engine power.

Figure 4:
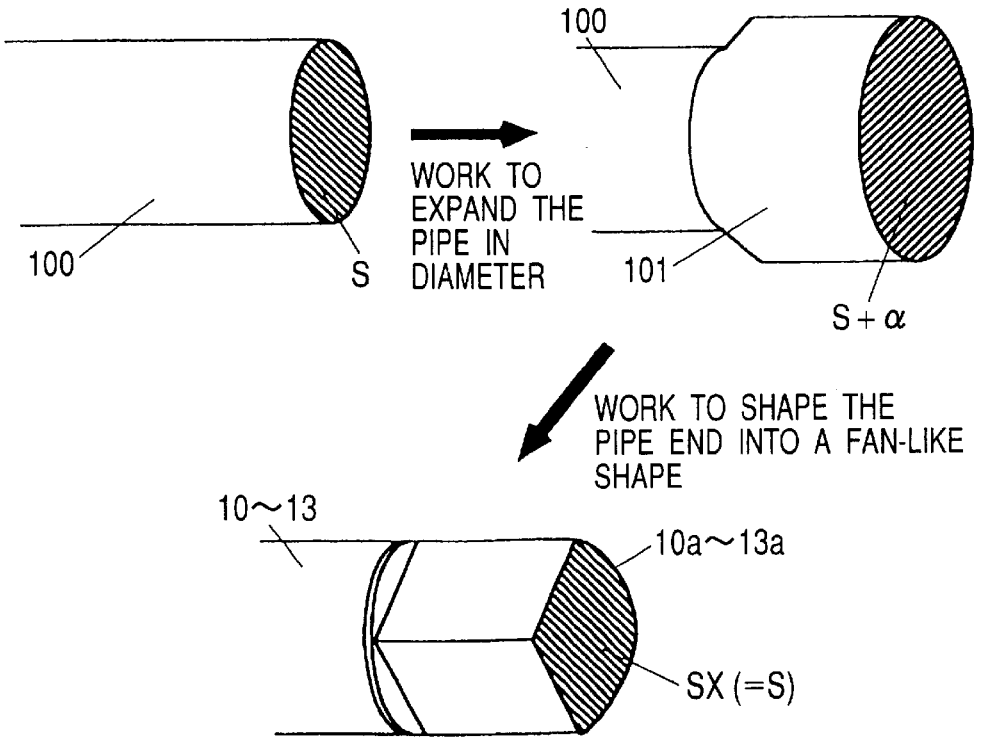
[FIG. 4]
Figure 5:
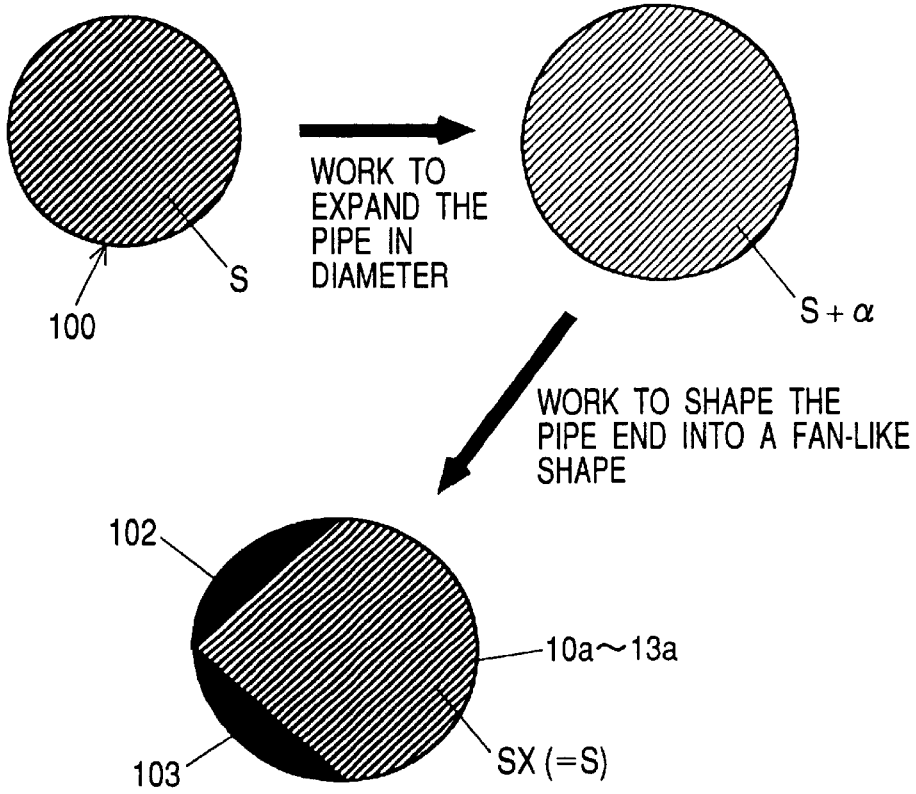
[FIG. 5]
Figure 6:
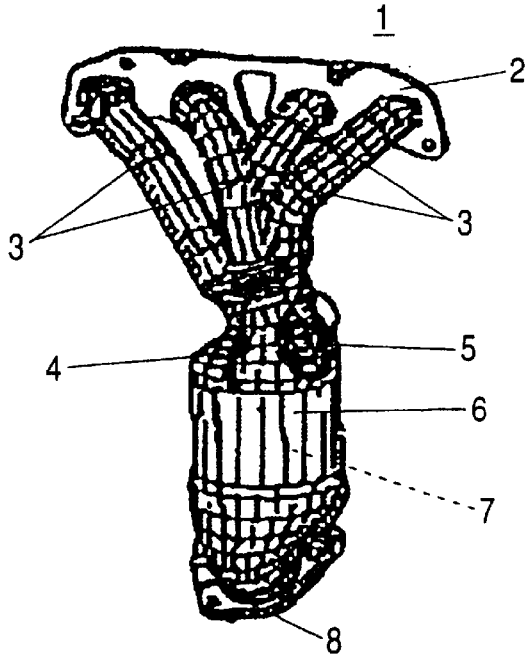
FIG. 6 (PRIOR ART)
[FIG. 6]
Figure 7:
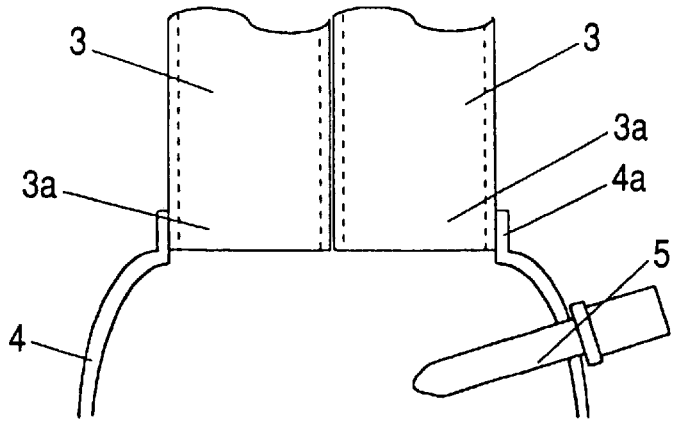
FIG. 7 (PRIOR ART)
[FIG. 7]
Figure 8:
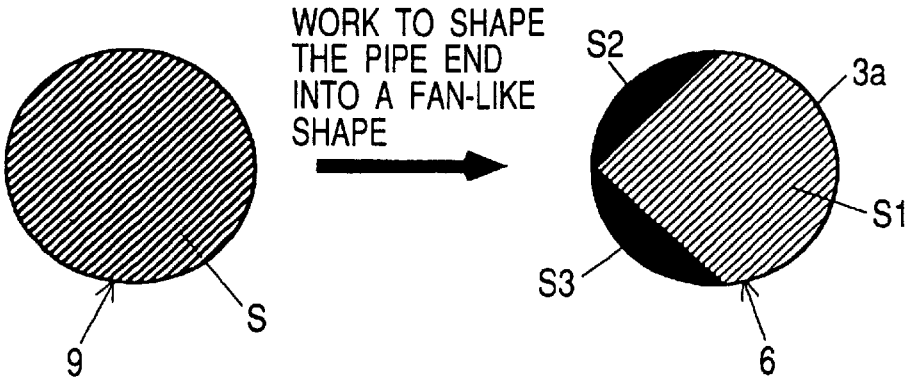
FIG. 8 (PRIOR ART)
[FIG. 8]

FIGS. 4 and 5 show a method of manufacturing the branch pipes 10, 11, 12, 13 (corresponding to aspect 2).

To start with, a pipe 100, which is circular in cross section, is prepared for working.

A cross section of the pipe 100 is S $mm^2$.

A part 101 corresponding to the parts (fitting parts) 10*a*, 11*a*, 12*a*, 13*a* to be fit into the branch pipe mounting part 31 is expanded in diameter.

As a result, a cross section area of the expanded part is $(S+\alpha)mm^2$.

Next, the expanded part is shaped into a fan-shaped part.

In the shaping process, crescent parts 102 and 103 as defined by a radius of the fan are crushed to be flat, and hence the resultant fan-shaped part is $\alpha$ $mm^2$ in cross section.

Accordingly, the cross section area SX $mm^2$ of the fan-shaped part (parts (fitting parts) 10*a*, 11*a*, 12*a*, 13*a* to be fit into the branch pipe mounting part 31) is equal to S $mm^2$: SX $mm^2$=S $mm^2$. That is to say, it is substantially equal to the cross section area of the ripe 100.

As described above, in the embodiment, the pipe having a circular cross section is expanded in diameter, and worked to have squeezed parts, and then, the resultant is shaped into the pipe part whose cross section is fan in shape. Therefore, the cross section area of the resultant part is substantially equal to that of the original pipe.

Concurrently with the progression of the above working process, the end parts of the branch pipes 10, 11, 12, 13 at which the branch pipes are mounted to the bracket 20 are each worked to have a rectangular cross section area.

As seen from the foregoing description, in the invention, a cross section area of the fitting part of the branch pipes is substantially equal to that of the original pipe of the branch pipe. Therefore, there is eliminated the decrease of the pressure loss caused by a configuration variation of the fitting part.

What is claimed is:

1. Branch pipes for an exhaust manifold comprising:

a group of pipe members which each has an upstream portion and a downstream fitting part which is adapted to be fitted into a manifold container, wherein a cross section of each fitting part of each said pipe member is shaped into a fan-like shape, and the cross-sectional area of each fitting part is substantially equal to a cross-sectional area of an upstream portion of each said pipe members.

2. The branch pipes for an exhaust manifold as defined in claim 1, wherein the number of said group of pipe members is four.

3. A method of manufacturing exhaust manifold branch pipes comprising the steps of:

expanding a downstream end of each of said branch pipes, and shaping said expanded downstream end of said branch pipes into a fan-like shape in cross section so that a cross sectional area of each downstream end is substantially equal to a sectional area of an upstream portion of each said branch pipe.

* * * * *